US012698604B2

(12) United States Patent
Sullivan

(10) Patent No.: US 12,698,604 B2
(45) Date of Patent: Aug. 4, 2026

(54) STOWABLE DOCK SYSTEM

(71) Applicant: Thomas John Sullivan, Edina, MN (US)

(72) Inventor: Thomas John Sullivan, Edina, MN (US)

( * ) Notice: Subject to any disclaimer, the term of this patent is extended or adjusted under 35 U.S.C. 154(b) by 824 days.

(21) Appl. No.: 17/964,499

(22) Filed: Oct. 12, 2022

(65) Prior Publication Data

US 2023/0114488 A1 Apr. 13, 2023

Related U.S. Application Data

(60) Provisional application No. 63/254,570, filed on Oct. 12, 2021.

(51) Int. Cl.
*E01D 19/00* (2006.01)
*E01D 19/04* (2006.01)

(52) U.S. Cl.
CPC ..... *E01D 19/005* (2013.01); *E01D 19/043* (2013.01)

(58) Field of Classification Search
CPC .... E04F 11/002; E04F 2011/007; A61G 3/06; A61G 3/061; E01D 19/005; E01D 19/043; E01D 15/24; B65G 69/00; B65G 69/30; B65G 69/243
See application file for complete search history.

(56) References Cited

U.S. PATENT DOCUMENTS 1,635,462 A * 7/1927 Cummings ..... E05D 3/12 16/366
4,248,004 A * 2/1981 Trotter ..... A01K 97/06 43/54.1
4,909,700 A * 3/1990 Fontecchio ..... A61G 3/067 254/10 R
6,179,545 B1 * 1/2001 Petersen, Jr. ..... A61G 3/061 14/71.7
7,001,132 B2 * 2/2006 Koretsky ..... A61G 3/061 414/921
8,122,553 B1 * 2/2012 Johnson ..... B60P 1/433 14/71.3
8,375,496 B1 * 2/2013 Johnson ..... A61G 3/067 14/71.3
8,533,884 B1 * 9/2013 Johnson ..... A61G 3/067 14/71.3
8,813,290 B1 * 8/2014 Morris ..... B66B 9/0869 14/71.3
9,440,808 B2 * 9/2016 Giemza ..... B65G 69/30
9,663,014 B1 * 5/2017 Welter ..... B65G 69/30
2008/0263790 A1 * 10/2008 Hoffman ..... B65G 69/30 14/71.1
2008/0302630 A1 * 12/2008 Yang ..... B65G 69/30 193/41

* cited by examiner

*Primary Examiner* — Abigail A Risic
(74) *Attorney, Agent, or Firm* — Dykema Gossett PLLC

(57) ABSTRACT

At least one of a method, apparatus, and system, as discussed herein and depicted in the figures that includes a first dock section, the first dock section including a first proximal end and a first distal end; a second dock section, the second dock section including a second proximal end and a second distal end; and a moveable guide system that connects the first dock section and the second dock section in a deployed position, such that the first proximal end of the first dock section abuts the second distal end of the second dock section, wherein the moveable guide system is configured to allow for the first dock section to be guided into a stowed position, on top of the second dock section.

20 Claims, 12 Drawing Sheets

STOWABLE DOCK SYSTEM

CROSS-REFERENCE TO RELATED APPLICATIONS

This application claims the benefit of U.S. provisional application No. 63/254,570, filed 12 Oct. 2021, which is hereby incorporated by reference as though fully set forth herein.

BACKGROUND a. Field of the Invention

The present disclosure relates generally to a stowable dock system.

b. Background Art

Docks can be used to better enable access to a location via water and further provide associated recreational opportunities. For example, a dock can be placed on a shoreline and can extend into an associated body of water; providing a location at which a boat can be docked; access to a lift on which a boat is stored; and/or a platform for recreational activities, such as swimming, fishing, etc. The length of a dock can vary greatly, depending on a personal preference of a user and/or a depth of water along the shoreline on which the dock is placed. For example, a gradual increase in depth along a shoreline can necessitate a longer dock than a rapid increase in depth along a shoreline. Accordingly, the length of a dock can range anywhere from less than 15 feet to upwards of 60 feet.

Generally, in northern climates where lakes freeze in the winter, docks are removed prior to the lakes freezing. Some docks are removed from the lake and stored on the shoreline. A dock that once extended into the lake by a distance of upwards of 60 feet is thus placed on the shoreline through portions of the fall, winter, and spring. The dock can not only be an eyesore, but can occupy a great deal of space on the shoreline for multiple months of the year.

SUMMARY

Various embodiments of the present disclosure include a dock system. In some embodiments, the dock system can include a first dock section, the first dock section including a first proximal end and a first distal end. In some embodiments, the dock system can include a second dock section, the second dock section including a second proximal end and a second distal end. In some embodiments, the dock system can include a moveable guide system that connects the first dock section and the second dock section in a deployed position, such that the first proximal end of the first dock section abuts the second distal end of the second dock section, wherein the moveable guide system is configured to allow for the first dock section to be guided into a stowed position, on top of the second dock section.

Various embodiments of the present disclosure include a dock system. In some embodiments, the dock system can include a first dock section, the first dock section including a first proximal end and a first distal end. In some embodiments, the dock system can include a second dock section, the second dock section including a second proximal end and a second distal end. In some embodiments, the dock system can include a moveable guide system, wherein the moveable guide system includes a first moveable guide system disposed on a first side of the dock system and a second moveable guide system disposed on a second side of the dock system. In some embodiments, the moveable guide system connects the first dock section and the second dock section in a deployed position, such that the first proximal end of the first dock section abuts the second distal end of the second dock section, wherein the moveable guide system is configured to allow for the first dock section to be guided into a stowed position, on top of the second dock section.

DETAILED DESCRIPTION

Figure 1A:
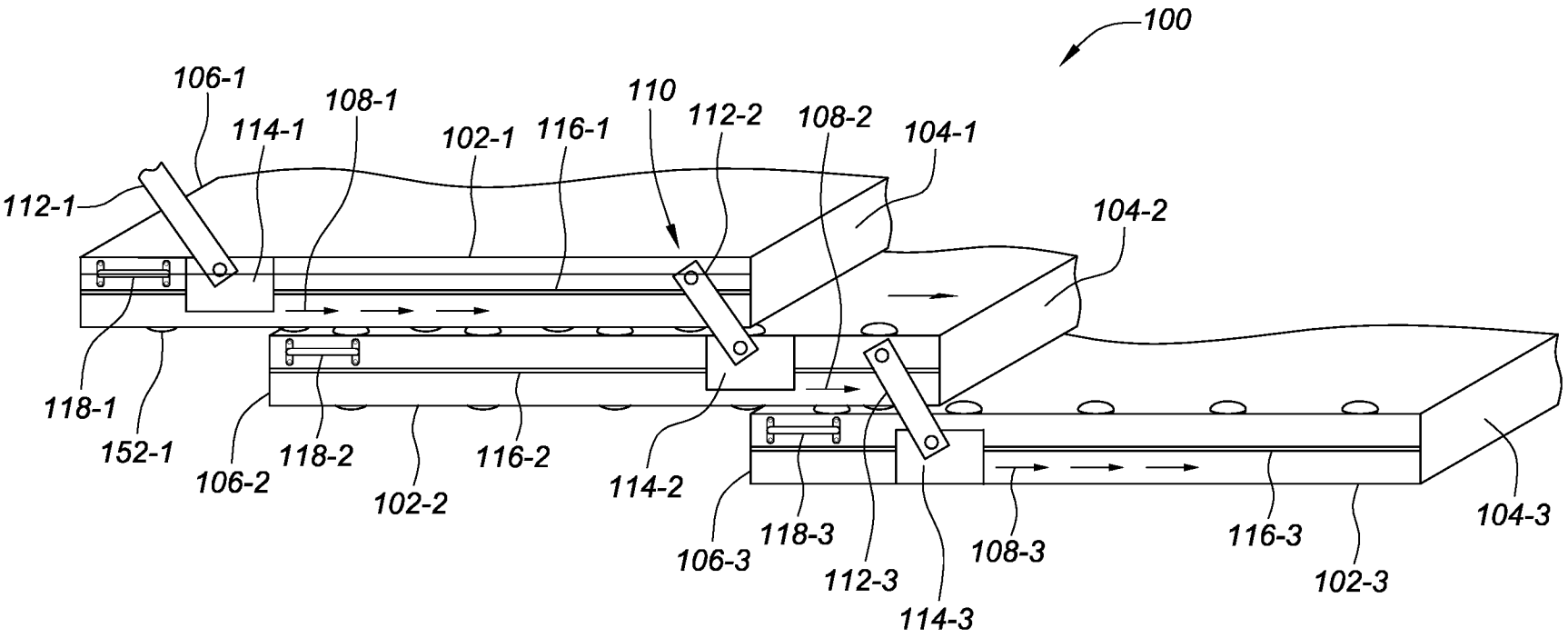
FIG. 1A depicts first, second, and third dock sections in a partially stowed state, in accordance with embodiments of the present disclosure.

Referring now to the drawings wherein like reference numerals are used to identify identical components in the various views, FIG. 1A is an isometric side view of a stowable dock system 100 that includes first, second and third dock sections 102-1, 102-2, 102-3, referred to in the plural herein as dock sections 102, each of which includes a moveable guide system, in accordance with embodiments of the present disclosure. FIG. 1A depicts the first, second, and third dock sections 102-1, 102-2, 102-3, hereinafter referred to in the plural as dock sections 102, in a partially stowed state. Each of the dock sections 102 can have a proximal end 104-1, 104-2, 104-3, and a distal end 106-1, 106-2, 106-3. In a deployed state, as further discussed herein, a proximal end 104-1 of the first dock section 102-1 can abut a distal end 106-2 of the second dock section 102-2, and a proximal end 104-2 of the second dock section 102-2 can abut a distal end 106-3 of the third dock section 102-3, thus allowing for the stowable dock system to extend its full length. In some embodiments, the tops of the first, second, and third dock sections 102-1, 102-2, 102-3 can be even with one another. As used herein, a proximal direction defines a direction located towards a shoreline on which the stowable dock system is placed and a distal direction defines an outward direction from the shoreline towards a body of water in which the stowable dock system 100 is placed. For example, in some embodiments, the proximal end 104-3 of the third dock section 102-3 can be disposed on land and/or an anchoring point.

As depicted, each of the dock sections 102 can include a moveable guide system. In some embodiments, corresponding dock sections (e.g., first dock section 102-1 and second dock section 102-2 and/or second dock section 102-2 and third dock section 102-3) can include a guide system 110 that allows for the corresponding dock sections to be stowed on top of one another. For example, the guide system 110 can be configured to allow a first dock section 102-1 to be proximally moved across the top of a second dock section 102-2, allowing for the first dock section 102-1 to be stowed on top of the second dock section 102-2, while maintaining longitudinal and/or lateral alignment between the first dock section 102-1 and the second dock section 102-2. As depicted in FIG. 1A, the first dock section 102-1 is in a partially stowed state and is being moved in a direction of arrows 108-2. As the first dock section 102-1 is moved proximally with respect to the second dock section 102-2, the guide system 110 can maintain an alignment (e.g., lateral alignment) between the first dock section 102-1 and the second dock section 102-2. In some embodiments, the guide system 110 can allow for the first dock section 102-1 to be moved proximally along a top of the second dock section 102-2, while preventing the first dock section 102-1 from being disconnected from the second dock section 102-2.

As depicted in FIG. 1A, in some embodiments, the guide system 110 can include a coupling arm 112-2 and a guide plate 114-2. In some embodiments, a distal end of the coupling arm 112-2 can be connected to a proximal end 104-1 of the first dock section 102-1, as further discussed herein. For example, the distal end of the coupling arm 112-2 can be connected to the proximal end 104-1 of the first dock section 102-1, such that the coupling arm 112-2 can pivot with respect to the first dock section 102-1, about an axis of a connector that connects the coupling arm 112-2 to the first dock section 102-1. In some embodiments, a proximal end of the coupling arm 112-2 can be connected to the guide plate 114-2. For example, the proximal end of the coupling arm 112-2 can be connected to the guide plate 114-2, such that the coupling arm 112-2 can pivot with respect to the guide plate 114-2, about an axis of a connector that connects the coupling arm 112-2 to the guide plate 114-2. In some embodiments, the guide plate 114-2 can be configured to move longitudinally along the second dock section 102-2. For example, in some embodiments, the guide plate 114-2 can be configured to engage a guide element 116-2, allowing for the guide plate 114-2 to be moved longitudinally in a proximal and/or distal direction along the guide element 116-2. In some embodiments, the guide element 116-2 can be a channel, groove, bar, or other longitudinally extending feature that allows for the guide plate 114-2 to be slidably coupled to the guide element 116-2, enabling the guide plate 114-2 to move longitudinally in proximal and/or distal directions. Further details associated with the guide plate 114-2 and the guide element 116-2 are discussed herein. For ease of illustration only, first sides of the first, second, and third dock sections 102 are depicted. However, opposite sides of the first, second, and third dock sections 102 can include the same or similar features as those depicted and discussed in relation to FIG. 1A. By including a guide system on opposing sides of each dock section, a better longitudinal alignment of adjacent dock sections 102 can be maintained when in stowed and/or partially stowed positions. Although reference is generally made to the guide system 110 connecting the first dock section 102-1 with the second dock section 102-2, same or similar guide systems can connect the second dock section 102-2 with the third dock section, for example, via coupling arm 112-3 and guide plate 114-3. The guide plate is capable of traveling along guide element 116-3, for example, in the direction of arrows 108-3, in order to place the dock sections 102-2, 102-3 in a stored configuration. Furthermore, the first dock section 102-1 can similarly include coupling arm 112-1 and guide plate 114-1, which is capable of traveling along guide element 116-1, for example, in the direction of arrows 108-1, in order to place the dock section 102-1 and an optional additional dock section, not shown, in a stored configuration. When the optional additional dock section is not included, the first dock section may not include the coupling arm 112-1 and guide plate 114-3.

In some embodiments, each of the dock sections 102 can include one or more handles 118-1, 118-2, 118-3 disposed on each dock section 102. As depicted in FIG. 1A, a handle 118 can be disposed at the distal end of each dock section 102. In some embodiments, a handle 118 can be disposed on either side of each dock section 102. In some embodiments, although not depicted, handles can be disposed on the proximal ends of each dock section 102, enabling a user to lift the proximal end of each dock section up and onto a top of an adjacent section, as depicted in FIG. 1A.

Although three dock sections 102 are depicted in relation to FIG. 1A, embodiments of the present disclosure can include a number of dock sections 102 in a range from two dock sections 102, upwards of ten dock sections 102. For example, in some embodiments, one or more additional dock sections can be connected via the coupling arm 112-1, allowing for a greater length of the dock system 100 in an extended configuration. Furthermore, although particular ones of the dock sections 102 may be discussed herein (e.g., dock section 102-2), other ones of the dock section can include the same or similar features.

Figure 1B:
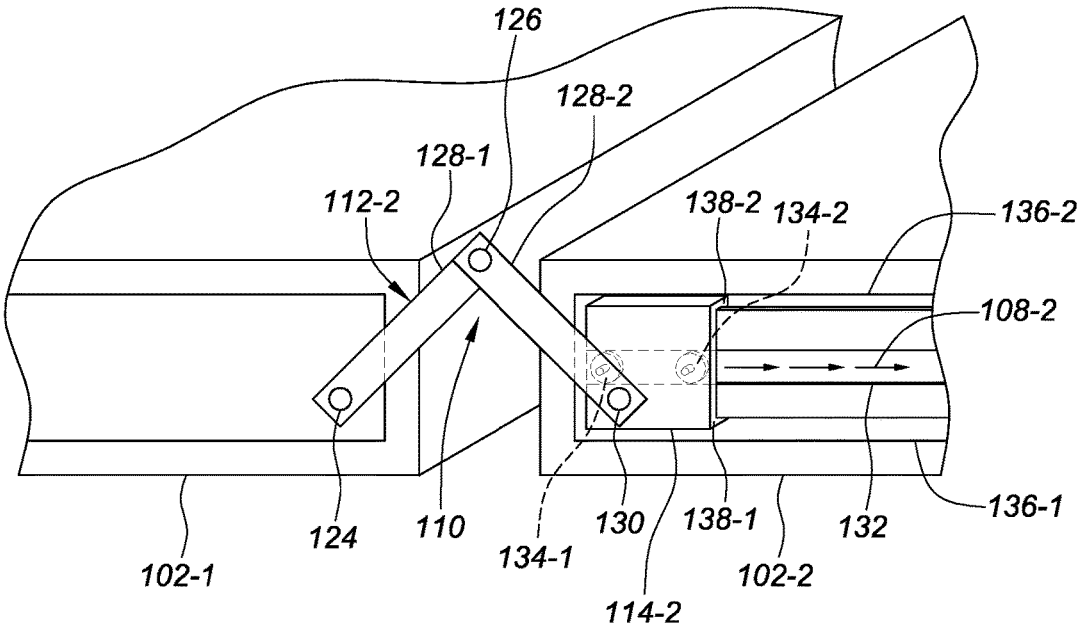
FIG. 1B is a close-up isometric side view of the first and second dock sections with a guide system, as depicted in FIG. 1A, in accordance with embodiments of the present disclosure.

FIG. 1B is a close-up isometric side view of the first and second dock sections 102-1, 102-2 with a guide system 110, as depicted in FIG. 1A, in accordance with embodiments of the present disclosure. As depicted, the coupling arm 112-2 can be attached at its distal end to the first dock section 102-1 via a fastener 124. In some embodiments, the fastener 124 can be a pin, bolt, etc., which allows the coupling arm 112-2 to pivot about an axis of the fastener 124. In some embodiments, the coupling arm 112-2 can include a hinge 126 that couples a first segment 128-1 and second segment 128-2 of the coupling arm 112-2. In some embodiments, the hinge 126 can allow the first and second segments 128-1, 128-2 to pivot about the hinge 126. A proximal end of the coupling arm 112-2 can be attached to the guide plate 114-2 via a fastener 130, allowing for the coupling arm 112-2 to pivot about an axis of the fastener 130. In some embodiments, the coupling arm 112-2 can pivot about the fastener 124, the hinge 126, and the fastener 130, allowing for the coupling arm 112-2 to expand (e.g., unfold) when the first dock section 102-1 is pulled distally apart from the second dock section 102-2. The proximal end of the first dock section 102-1 can then be lifted up and over the distal end of the second dock section 102-2.

As depicted, the proximal end of the coupling arm 112-2 is connected to the guide plate 114-2 via the fastener 130. In some embodiments, the guide plate 114-2 can be disposed along a guide element 132, as discussed in FIG. 1A. In some embodiments, the guide element 132 can include a guide groove in which guides 134-1, 134-2 can reside. In some embodiments, the guides 134-1, 134-2 can be wheels that are disposed in the guide groove 132, further discussed herein. In some embodiments, the guide element 132 can include one or more secondary guide grooves 136-1, 136-2, in which secondary guides 138-1, 138-2 are disposed. For example, the secondary guides 138-1, 138-2 can hook into the secondary guide grooves 136-1, 136-2, preventing the guide plate 114-2 from being removed from the second dock section 102-2.

Upon lifting the proximal end of the first dock section 102-1 up and onto the top of the second dock section 102-2, the first dock section 102-1 can be longitudinally and proximally moved along the top of the second dock section 102-2. Upon proximal movement of the first dock section 102-1, the guide plate 114-2 can move proximally along the guide element 132, helping to maintain a longitudinal movement of the first dock section 102-1 along the top of the surface of the second dock section 102-2. For example, the guide plate 114-2 and its associated components, along with the coupling arm 112-2 can maintain a longitudinal movement of the first dock section 102-1 along the top of the surface of the second dock section 102-2.

Figure 1C:
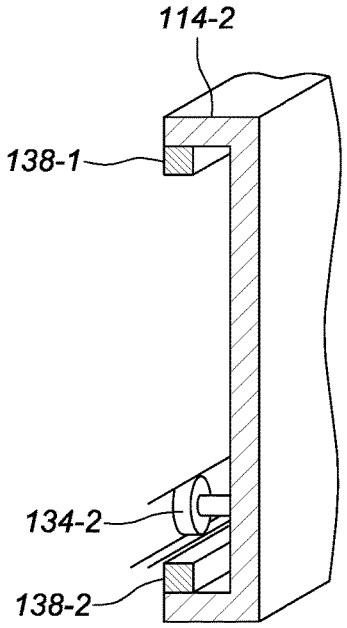
FIG. 1C is a cross-sectional view of a guide plate, in accordance with embodiments of the present disclosure.
Figure 1D:
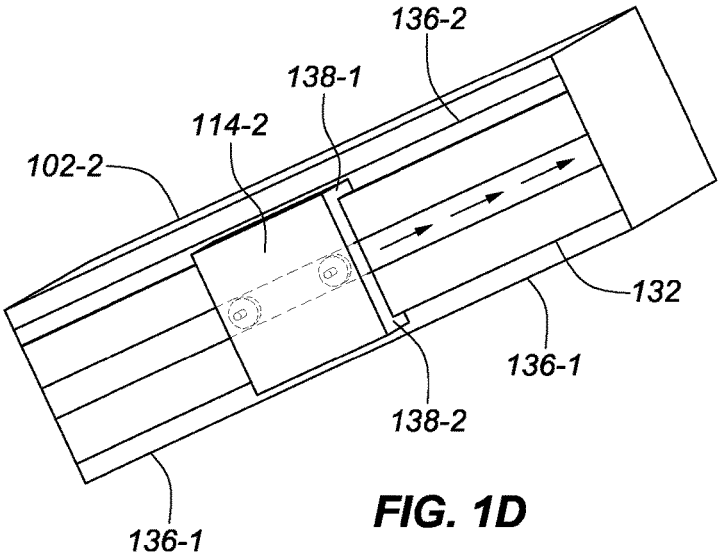
FIG. 1D is an isometric side view of the guide plate depicted in FIG. 1C and an associated dock section, in accordance with embodiments of the present disclosure.

FIG. 1C is a cross-sectional view of a guide plate 114-2, in accordance with embodiments of the present disclosure. FIG. 1D is an isometric side view of the guide plate 114-2 depicted in FIG. 1C and an associated dock section 102-2, in accordance with embodiments of the present disclosure. As discussed in relation to FIG. 1B, the guide plate 114-2 can include one or more guides 134-1 and secondary guides 138-1, 138-2, which can be disposed in respective guide groove 132 and secondary guide grooves 136-1, 136-2. This can allow for the plate to be longitudinally moved along the dock section 102-2, without detaching from the dock section 102-2. For example, the secondary guides 138-1, 138-2 can be locked into respective secondary guide grooves 136-1, 136-2.

Figure 1E:
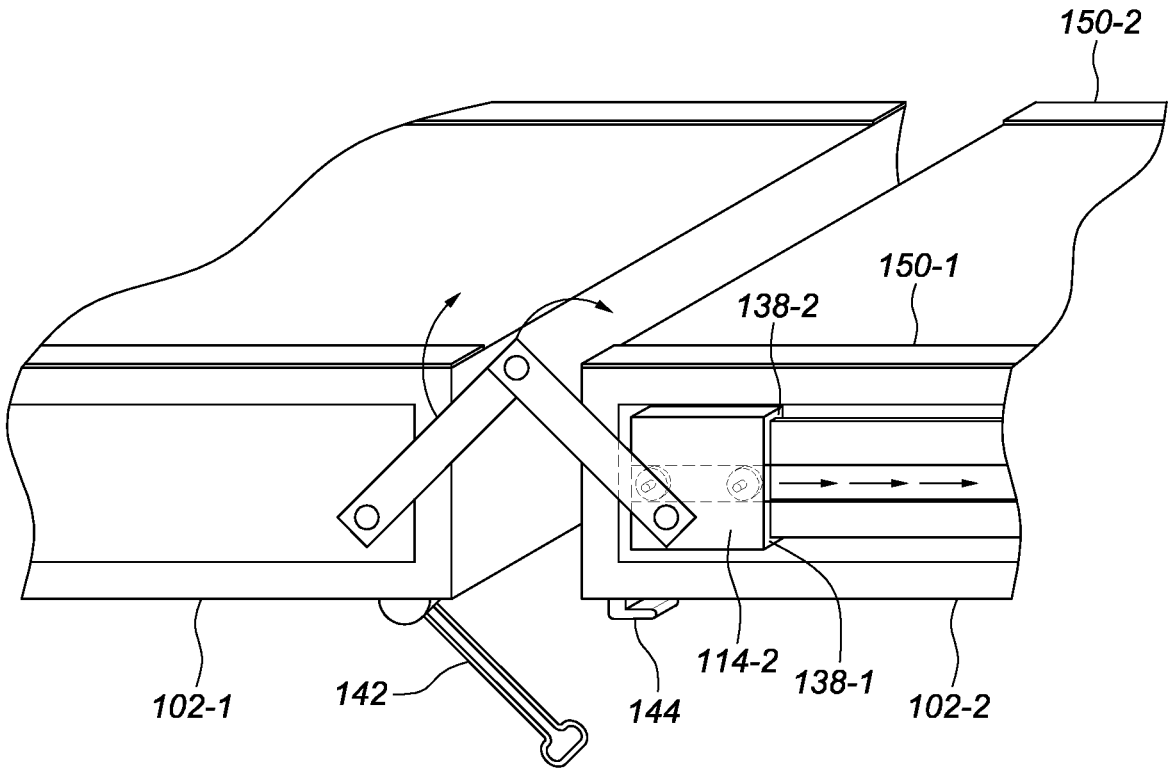
FIG. 1E is a close-up isometric side view of the first and second dock section with a moveable coupling system, as depicted in FIG. 1A, with the addition of friction reducing elements disposed on a top of the second dock section, in accordance with embodiments of the present disclosure.

FIG. 1E is a close-up isometric side view of the first and second dock section 102-1, 102-2 with a moveable coupling system, as depicted in FIG. 1A, with the addition of friction reducing elements 150-1, 150-2 disposed on a top of the second dock section, in accordance with embodiments of the present disclosure. Embodiments depicted and discussed in relation to FIG. 1E can include the same features as those embodiments discussed herein in relation to FIGS. 1A to 1D. In some embodiments, the dock sections 102-1, 102-2 can be fastened together to prevent the dock sections 102-1, 102-2 from coming apart. As depicted in FIG. 1E, in some embodiments, the dock sections 102-1, 102-2 can be fastened together via first and second connecting elements 142, 144. In an example, the first connecting element 142 can be a bungie configured to connect with the second connecting element 144, thus drawing a proximal end of the first dock section 102-1 into a distal end of the second dock section 102-2. In some embodiments, the first dock section 102-1 and the second dock section 102-2 can include a corresponding set of pins on their corresponding proximal and distal ends. For example, one of the proximal and distal end can include at least one pin and the corresponding proximal or distal end can include a corresponding hole through which the pin can be inserted, thus allowing for alignment of the top decking surfaces of the first dock section 102-1 and the second dock section 102-2. In some embodiments, the first connecting element 142 can include a turnbuckle or other similar connecting element configured to attach the first dock section 102-1 with the second dock section 102-2.

In stead of including a bottom guide groove 136-1, as depicted in FIG. 1B, in some embodiments, a bottom edge of the second dock section 102-2 can serve as a guide element that corresponds with a bottom one of the secondary guides 138-2. As such, an additional manufacturing step of constructing a secondary guide groove can be eliminated by utilizing the bottom edge of the second dock section 102-2.

Figure 1F:
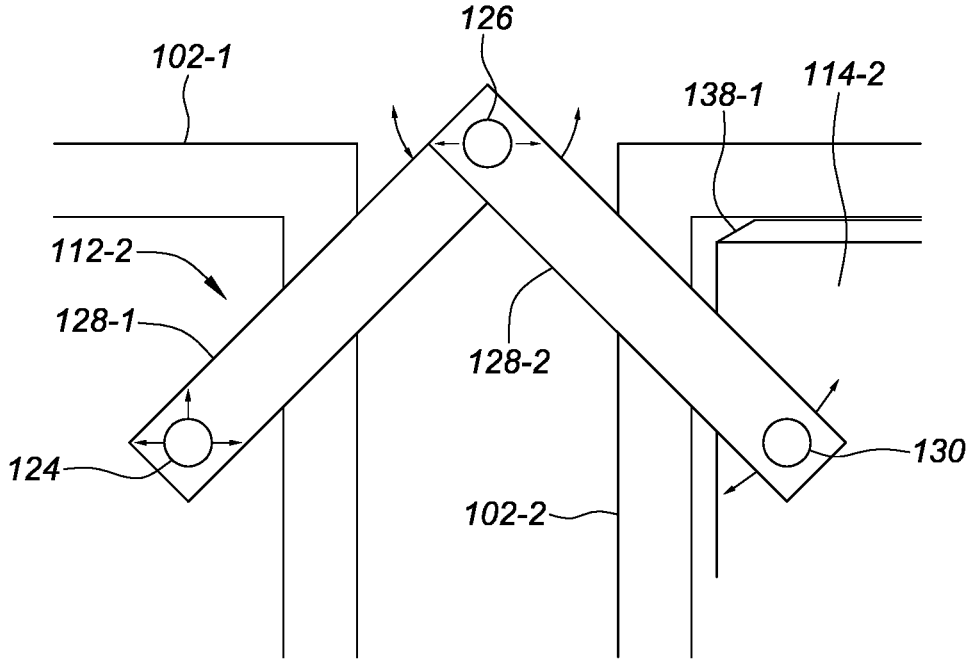
FIG. 1F is a side view of the first and second dock sections and guide system, as depicted in FIG. 1B, in accordance with embodiments of the present disclosure.
Figure 1G:
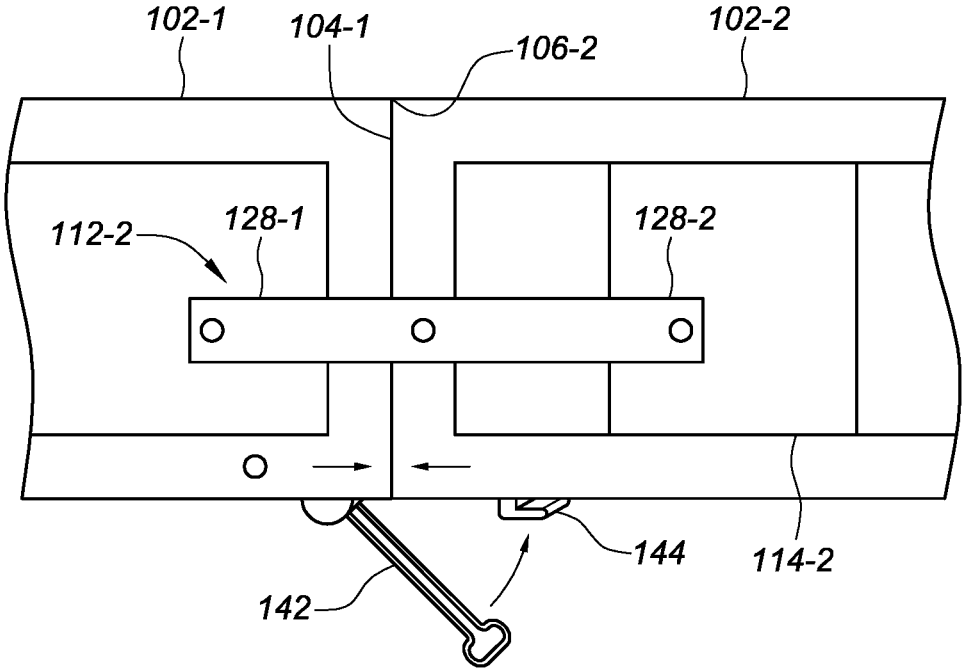
FIG. 1G is an isometric side view of the first and second dock section depicted in FIG. 1A with a guide system, in accordance with embodiments of the present disclosure.
Figure 1H:
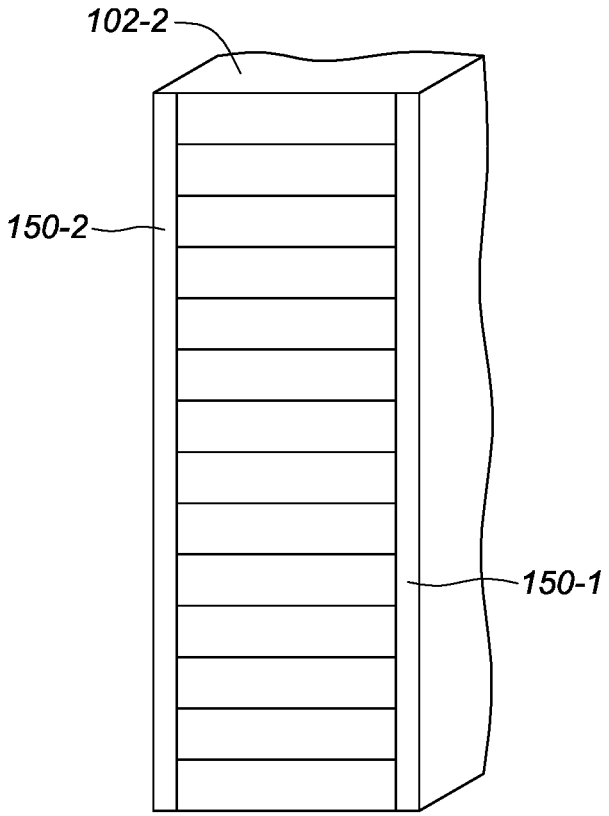
FIG. 1H is a top view of the second dock section, depicted in FIG. 1A, with friction reducing elements disposed on a top of the second dock section, in accordance with embodiments of the present disclosure.

In some embodiments, a top surface of the second dock section 102-2 can include friction reducing elements 150-1, 150-2, which can longitudinally extend along a surface of the top of the second dock section, as further discussed in relation to FIG. 1H. In some embodiments, the friction reducing elements 150-1, 150-2 can be configured to reduce a friction between the dock sections when the first dock section 102-1 is slide over the second dock section 102-2.

FIG. 1F is a side view of the first and second dock sections 102 and guide system 110, as depicted in FIG. 1B, in accordance with embodiments of the present disclosure. The embodiments depicted in FIG. 1F can include the same or similar features as those discussed in relation to at least FIGS. 1A to 1E and better illustrates the pivoting action of the coupling arm 112-2. Although the coupling arm 112-2 is depicted as a two-piece design, in some embodiments, not depicted, the coupling arm 112-2 can be a single piece design. For example, the coupling arm 112-2 can be formed of a single piece of material that does not include a hinge 126 (e.g., is rigid). For example, in some embodiments, the coupling arm 112-2 can be a solid piece of material that is straight (i.e., extends longitudinally and does not include any bends such as those depicted in relation to the coupling arm 112-2). Embodiments of the present disclosure that have a rigid coupling can have the guide plate 114-2 that is positioned more proximally than the guide plate 114-2 depicted in FIG. 1F when the dock is in a deployed configuration (e.g., when the proximal end of the first dock section 102-1 and the distal end of the second dock section 102-2 abut one another). This can allow for the first dock section 102-1 to be moved distally from the second dock section 102-2 when attempting to stow the first dock section 102-1 on top of the second dock section 102-2.

FIG. 1G is an isometric side view of the first and second dock sections 102-1, 102-2 depicted in FIG. 1A with a guide system 110, in accordance with embodiments of the present disclosure. As depicted in FIG. 1G, the first and second dock sections 102-1, 102-2 are depicted in a deployed state, where their proximal end 104-1 and distal end 106-2 of the dock sections 102 abut one another. In some embodiments, the first connecting element 142, which is depicted as a rubber strap, can be stretched and placed over the second connecting element 144, pulling the first dock section 102-1 and the second sock section 102-2 together, and preventing accidental uncoupling from one another. As previously mentioned herein, the first dock section 102-1 and the second dock section 102-2 can include alignment features on their proximal and distal ends.

As further depicted in FIG. 1G, the coupling arm 112-2 can include first and second segments 128-1, 128-2, which are shown in an extended orientation, such that the coupling arm 112-2 is longitudinally extended and generally parallel with a longitudinal axis extending through the first and second dock sections 102. Although the coupling arm 112-2 is depicted as jointed, the coupling arm 112-2, as discussed herein, can be formed from one solid piece of material and in some embodiments can be a longitudinally extending straight piece of material. In operation, the first dock section 102-1 can be separated from the second dock section 102-2 by pulling the first dock section 102-1 distally from the second dock section 102-2, allowing for the guide plate 114-2 to be moved distally. The proximal end 104-1 of the first dock section 102-1 can then be lifted in an upward direction, such that the proximal end 104-1 of the first dock section 102-1 can be moved over a top surface and distal end 106-2 of the second dock section 102-2.

FIG. 1H is a top view of the second dock section 102-2, depicted in FIG. 1A, with friction reducing elements 150-1, 150-2 disposed on a top of the second dock section 102-2, in accordance with embodiments of the present disclosure. In some embodiments, the friction reducing elements 150-1, 150-2 can be strips of material disposed along a top surface of the second dock section 102-2, which can reduce a friction between a dock section (e.g., dock section 102-2) and a corresponding dock section (e.g., dock section 102-1), as it slides over the dock section. In an example, the friction reducing elements 150-1, 150-2 can be formed from a metal material and/or a high density polymer material (e.g., plastic). As depicted, in some embodiments, each one of the friction reducing elements 150-1, 150-2 can be disposed on either side of the top surface of the second dock section 102-2.

Figure 1I:
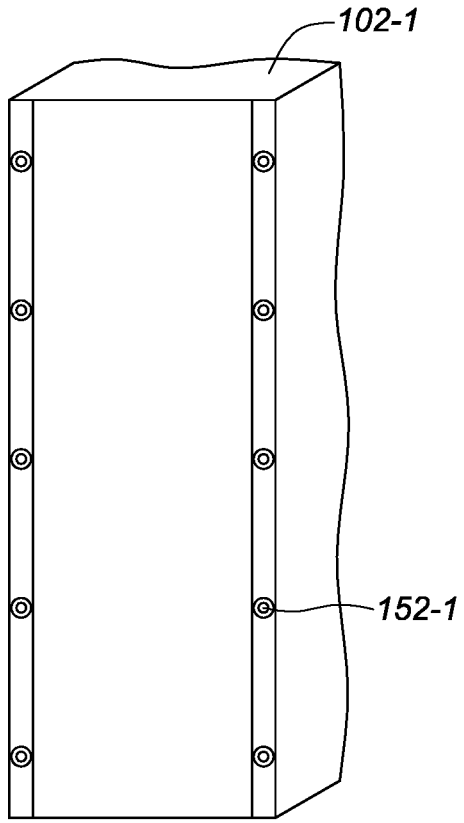
FIG. 1I is a bottom view of the first dock section, depicted in FIG. 1A, with friction reducing elements disposed on a bottom of the first dock section, in accordance with embodiments of the present disclosure.

FIG. 1I is a bottom view of the first dock section 102-1, depicted in FIG. 1A, with friction reducing elements 152-1 disposed on a bottom of the first dock section 102-1, in accordance with embodiments of the present disclosure. In some embodiments, a bottom surface of the first dock section 102-1 can include friction reducing elements 152-1 that correspond to the top surface of the second dock section 102-2, also depicted in FIG. 1A. In some embodiments, the corresponding friction reducing element 152-1 can engage with the friction reducing element 150-1 to allow the first dock section 102-1 to slide along a top surface of the second dock section 102-2. For example, in some embodiments, the friction reducing elements 152-1 can include transfer bearings, which can be configured to roll along the friction reducing element 150-1, allowing for reduced effort in sliding the first dock section 102-1 over the second dock section 102-2.

Figure 1J:
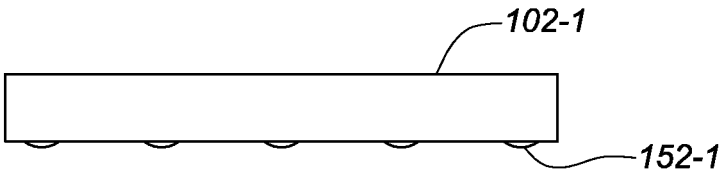
FIG. 1J is a side view of the first dock section depicted in FIG. 1I, in accordance with embodiments of the present disclosure.

FIG. 1J is a side view of the first dock section 102-1 depicted in FIG. 1I, in accordance with embodiments of the present disclosure. As depicted, the friction reducing elements 152-1 can extend from a bottom side of the first dock section 102-1, enabling the friction reducing elements 152-1 to engage with the friction reducing elements 150-1 on the top surface of a corresponding second dock section 102-2. In some embodiments, a groove can be defined in the bottom surface of the first dock section 102-1 in which the friction reducing elements 152-1 are disposed, such that it minimizes an exposure of the transfer wheels.

Figure 1K:
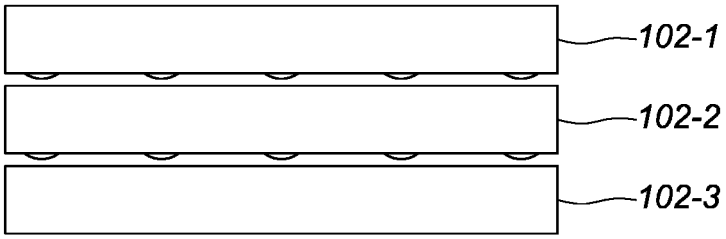
FIG. 1K is a side view of multiple stacked dock sections that include friction reducing elements, in accordance with embodiments of the present disclosure.

FIG. 1K is a side view of multiple stacked dock sections 102-1, 102-2, 102-3 that include friction reducing elements, in accordance with embodiments of the present disclosure. As can be seen, in a stowed configuration, the dock sections 102 can take up one-third of the length as they would when the dock sections 102 are in a deployed configuration.

Figure 2:
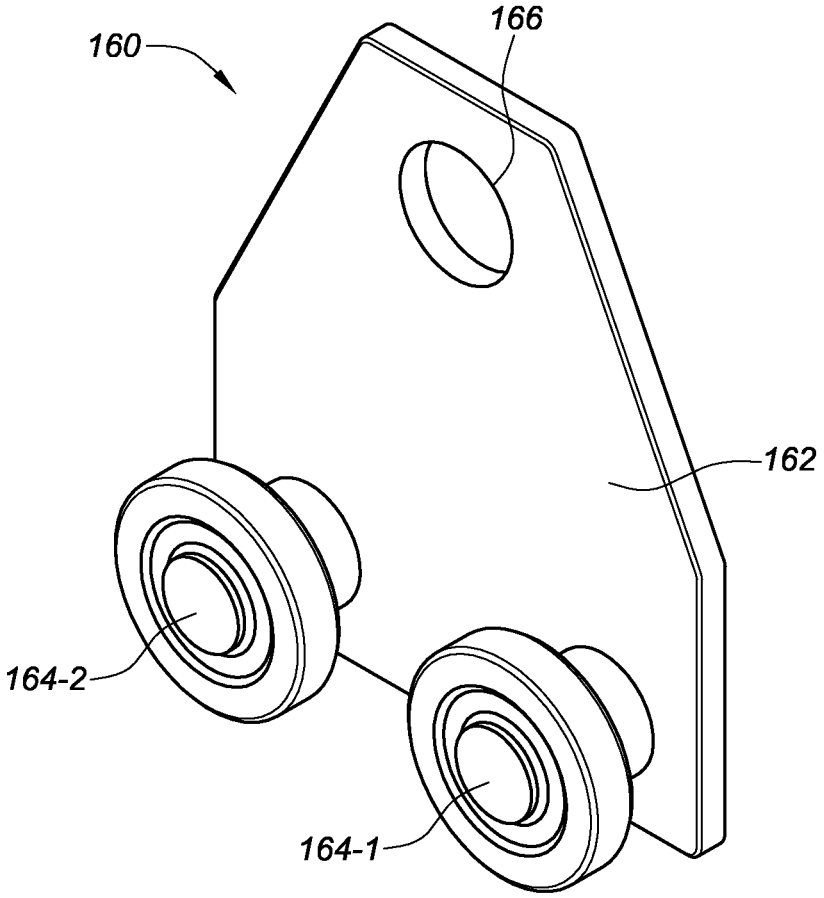
FIG. 2 is an isometric side view of a guide plate, in accordance with embodiments of the present disclosure.

FIG. 2 is an isometric side view of a guide plate 160, in accordance with embodiments of the present disclosure. As depicted, the guide plate 160 can include guides 164-1, 164-2, which are depicted as including rollers, which can be configured to be disposed within a channel and/or groove, as previously discussed herein. In some embodiments, a plate 162 to which the guides 164-1, 164-2 are attached can define a hole 166 through which a coupling arm can be bolted.

Figure 3A:
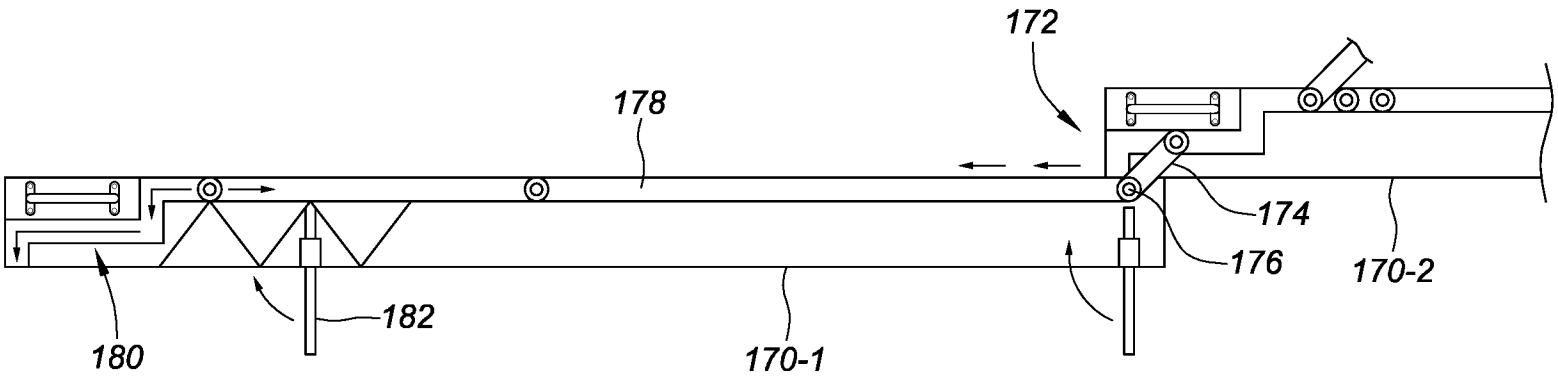
FIG. 3A is a side view of a first and second dock section with a guide system, in accordance with embodiments of the present disclosure.

FIG. 3A is a side view of a first and second dock section 170-1, 170-2 with a guide system 172, in accordance with embodiments of the present disclosure. In some embodiments, the guide system 172 can include a coupling arm 174, a first side of which is attached to a distal end of the second dock section 170-2. In some embodiments, a second side of the coupling arm 174 can be attached to a wheel 176. In some embodiments, the wheel 176 can be configured to ride in a groove 178, allowing for the second dock section 170-2 to be rolled along the top of the first dock section 170-1, such that the second dock section 170-2 can be stowed on top of the first dock section 170-1. In some embodiments, the coupling arm 174 and associated wheel 176 can be attached to a proximal end of the first dock section 170-1, such that the first dock section 170-1 can be stowed on top of the second dock section 170-2. In some embodiments, the distal end of the groove 178 can include a stepped groove portion 180 into which the wheel 176 can travel, allowing the wheel 176 to drop down into the stepped groove such that a bottom surface of the second dock section 170-2 can lie on top of the top surface of the first dock section 170-1. In some embodiments, the first and/or second dock sections can include foldable legs 182, which can be retracted in a stowed configuration and lowered in a deployed configuration.

Figure 3B:
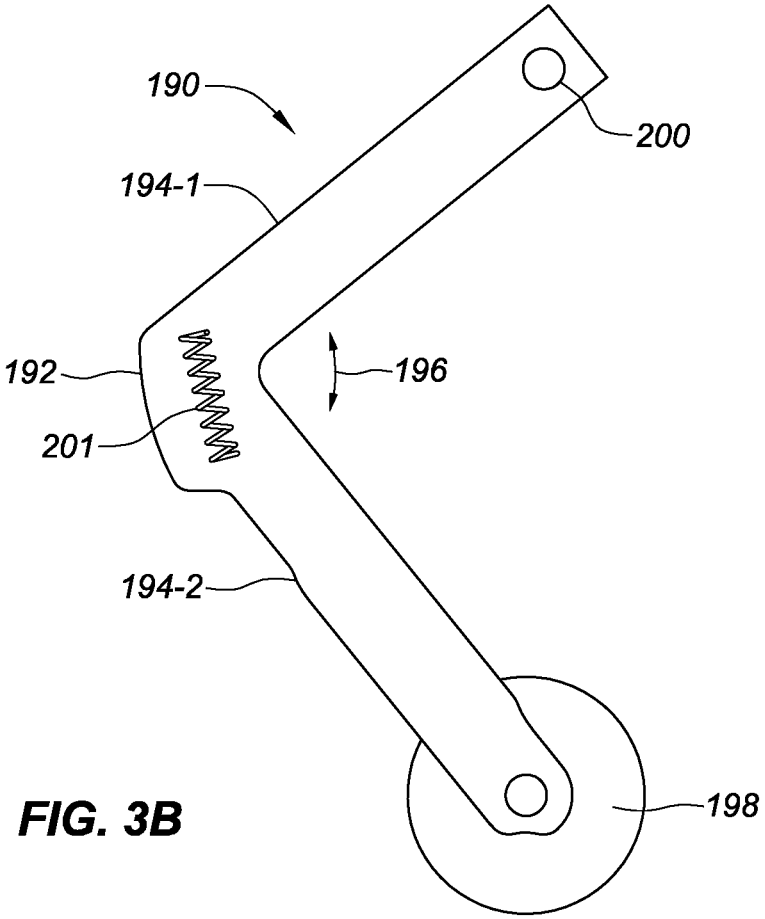
FIG. 3B is a side view of a coupling arm, in accordance with embodiments of the present disclosure.

FIG. 3B is a side view of a coupling arm 190, in accordance with embodiments of the present disclosure. As depicted, in some embodiments, the coupling arm 190 can be hinged, such that the coupling arm 19 can pivot about the hinge 192, causing first and second coupling arms 194-1, 194-2 to open in a direction of arrow 196. In some embodiments, the coupling arm 190 can be used in conjunction with embodiments disclosed in FIG. 3A, for example, the coupling arm 190 can be used as coupling arm 174. When a first and second dock section are in a deployed position, the coupling arm 190 can be in the configuration depicted in FIG. 3B. When the first and second dock section are proximally and distally pulled apart in the process of stowing the first and second dock section, the first and second coupling arms 194-1, 194-2 can open in the direction of arrow 196. As further depicted, the coupling arm can include a wheel 198 disposed at an end of the second coupling arm 194-2 and a hole 200 through which the end of the first coupling arm 194-1 can be attached to a dock section.

In some embodiments, the hinge 192 can be a spring hinge that includes a spring 201, which is configured to naturally bias the hinge 192 into a closed position. In some embodiments, this can help retain a first dock section against a second dock section.

Figure 3C:
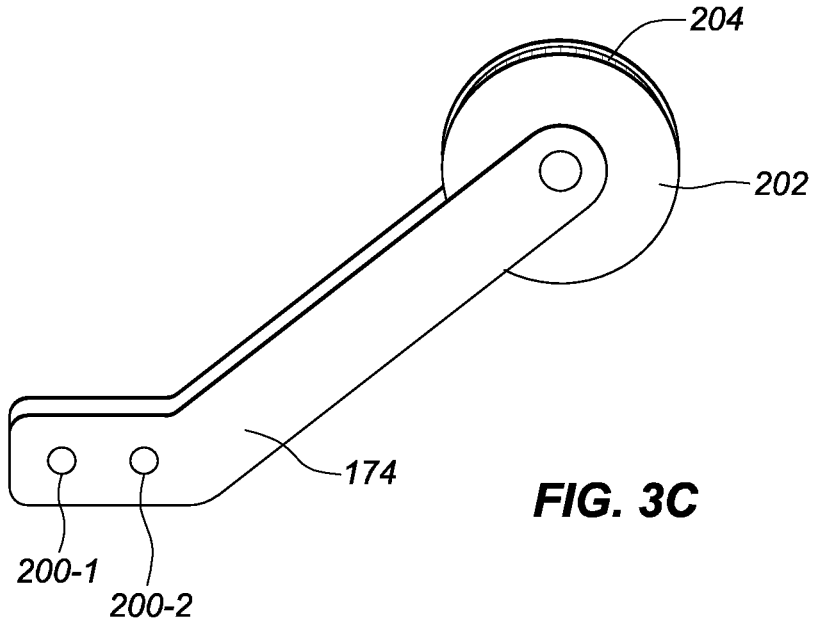
FIG. 3C is side view of another embodiment of a coupling arm, in accordance with embodiments of the present disclosure.

FIG. 3C is a side view of another embodiment of a coupling arm, in accordance with embodiments of the present disclosure. The coupling arm can be the same as the coupling arm 174 depicted in FIG. 3A. The coupling arm 174 can be a bent coupling arm, as depicted and can include mounting holes 200-1, 200-2, which can be used for mounting the coupling arm 174 to a dock section. As depicted, the coupling arm 174 can include a wheel 202 connected to a portion of the coupling arm 174 opposite of the mounting holes 200-1, 200-2. In some embodiments, the wheel 202 can include a groove 204 defined about an outer circumference of the wheel 202. In some embodiments, as discussed herein, the groove 204 of the wheel can be configured to ride along a guide element, such as further discussed in FIG. 5A.

Figure 4A:
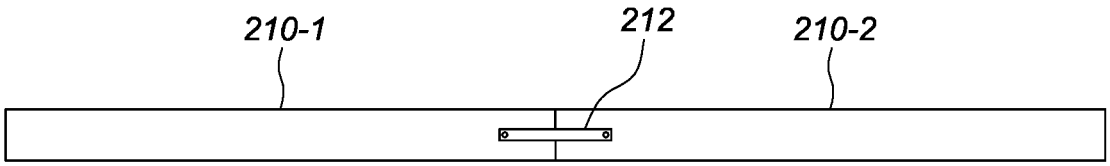
FIGS. 4A to 4D illustrate a first and second dock section in relation to a principle of operation, in accordance with embodiments of the present disclosure.
Figure 4B:
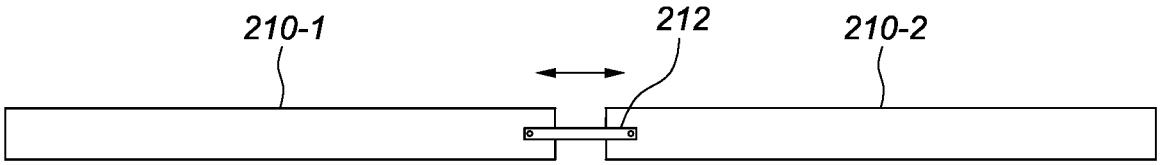
Figure 4C:
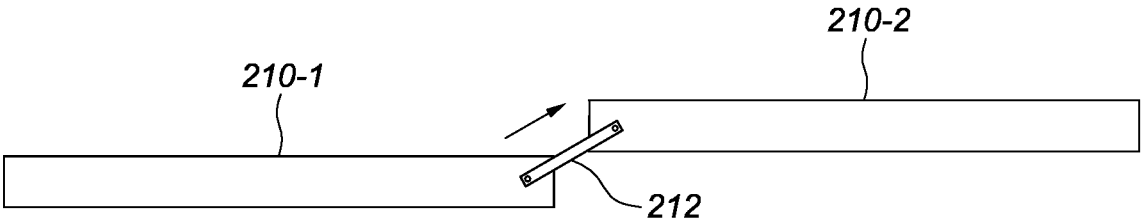
Figure 4D:
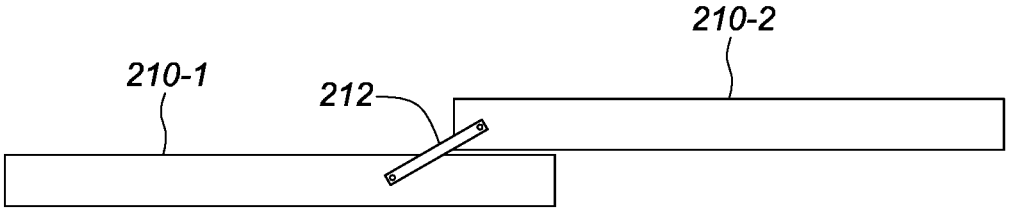

FIGS. 4A to 4D illustrate a first and second dock section 210-1, 210-2 in relation to a principle of operation in accordance with embodiments of the present disclosure. FIG. 4A depicts the first dock section 210-1 and second dock section 210-2, with coupling arm 212, in a deployed state. FIG. 4B depicts the first dock section 210-1 and second dock section 210-2, with coupling arm 212, in a separated state. FIG. 4C depicts the first dock section 210-1 and second dock section 210-2, with coupling arm 212, in a second separated state, with the second dock section 210-2 being partially elevated with respect to the first dock section 210-1. FIG. 4D depicts the first dock section 210-1 and second dock section 210-2, with coupling arm 212, in a partially stowed state.

Figure 5A:
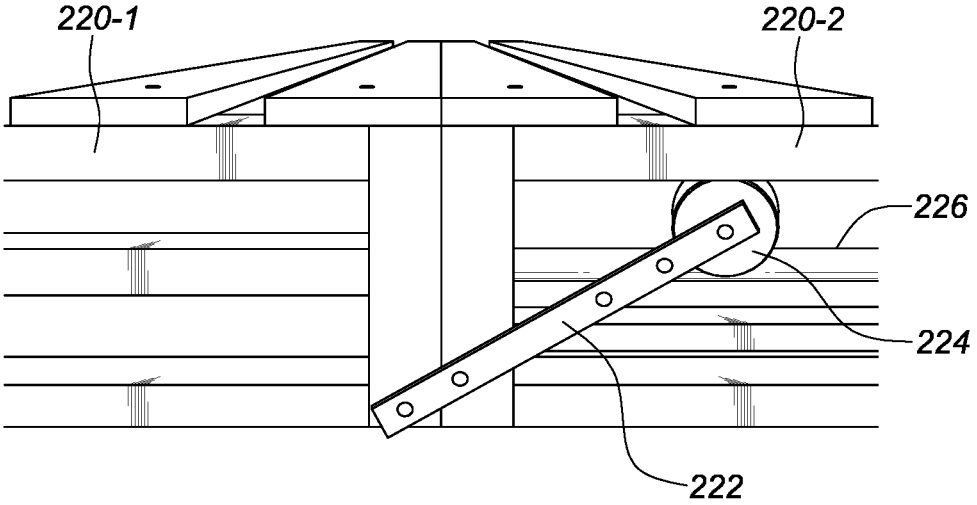
FIGS. 5A to 5D illustrate a first and second dock section in relation to a principle of operation, in accordance with embodiments of the present disclosure.
Figure 5B:
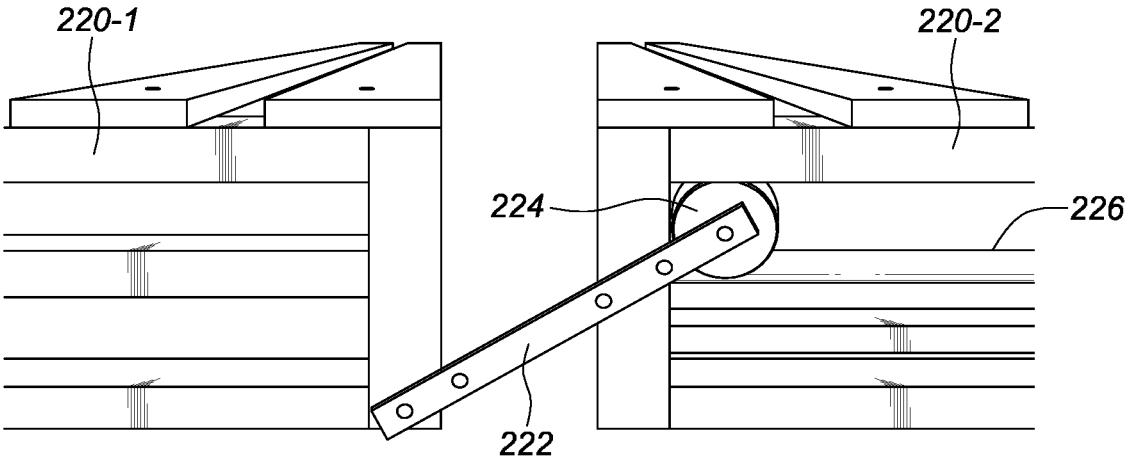
Figure 5C:
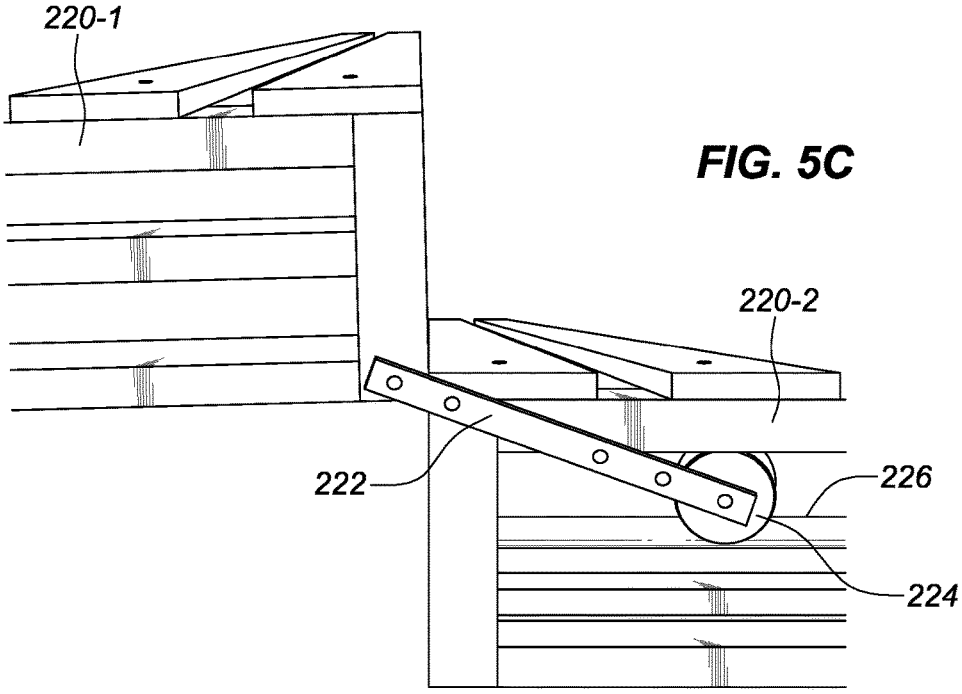
Figure 5D:
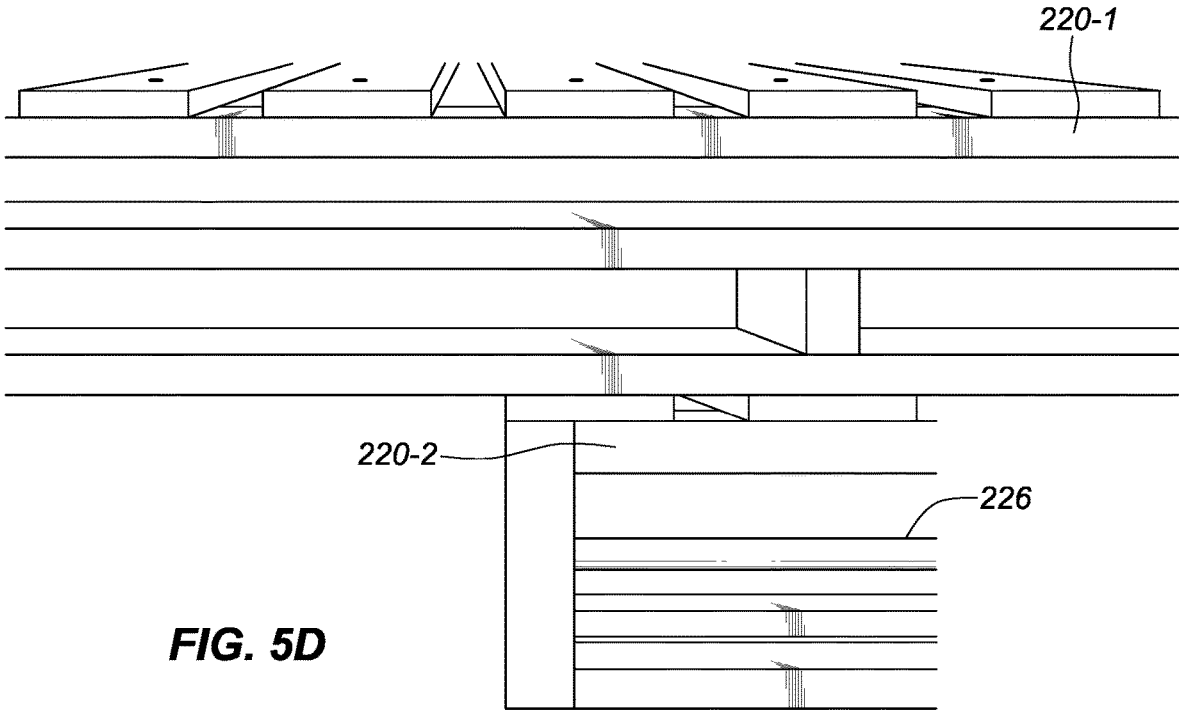

FIGS. 5A to 5D illustrate a first and second dock section 220-1, 220-2 in relation to a principle of operation in accordance with embodiments of the present disclosure. FIG. 5A depicts the first dock section 220-1 and second dock section 220-2, with coupling arm 222 and wheel 224, in a deployed state. As depicted, the wheel 224 can ride on a pipe 226 (e.g., guide element) extending longitudinally along the second dock section 220-2, which can be anchored to vertical supports of the dock section 220-2, as depicted. FIG. 5B depicts the first dock section 220-1 and second dock section 220-2, with coupling arm 222 and wheel 224, in a separated state. FIG. 5C depicts the first dock section 220-1 and second dock section 220-2, with coupling arm 222 and wheel 224, in a second separated state, with the second dock section 220-2 being partially elevated with respect to the first dock section 220-1. As depicted, the coupling arm 222 has pivoted and the wheel 224 has traveled proximally along the pipe 226. As the wheel 224 travels proximally along the pipe 226, the wheel can be retained between a top rail of the second dock section, as depicted, and the pipe 226. Although the embodiments depicted in FIG. 5C utilize a pipe 226 as a guide for the wheel 224, the guide could be formed out of other types of stock, as long as they allow for the wheel to be guided along the dock section when the first dock section 102-1 is moved proximally or distally with respect to the second dock section 102-2. FIG. 5D depicts the first dock section 220-1 and second dock section 220-2 in a partially stowed state.

Figure 6A:
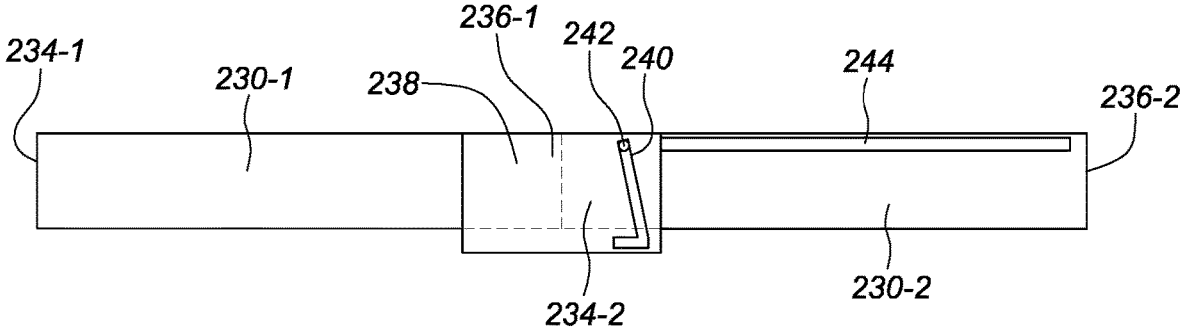
FIGS. 6A to 6C illustrate a first and second dock section in relation to a principle of operation of an alternate embodiment, in accordance with embodiments of the present disclosure.
Figure 6B:
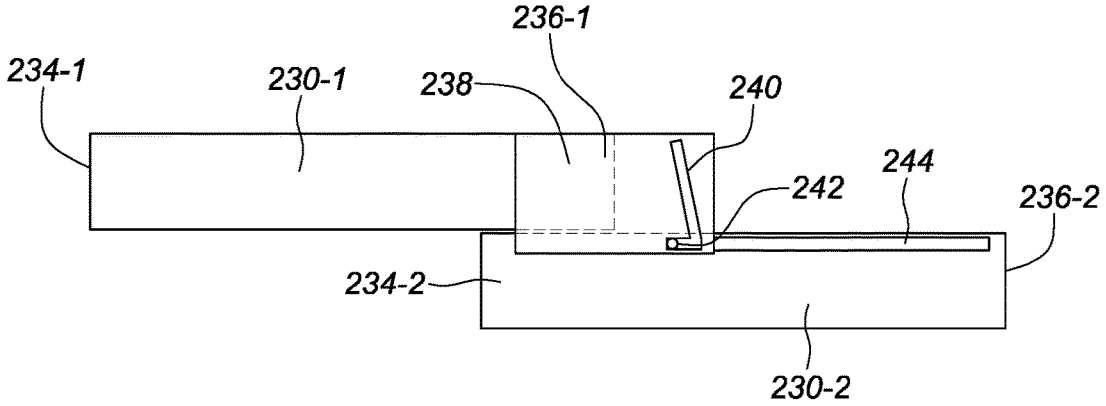
Figure 6C:
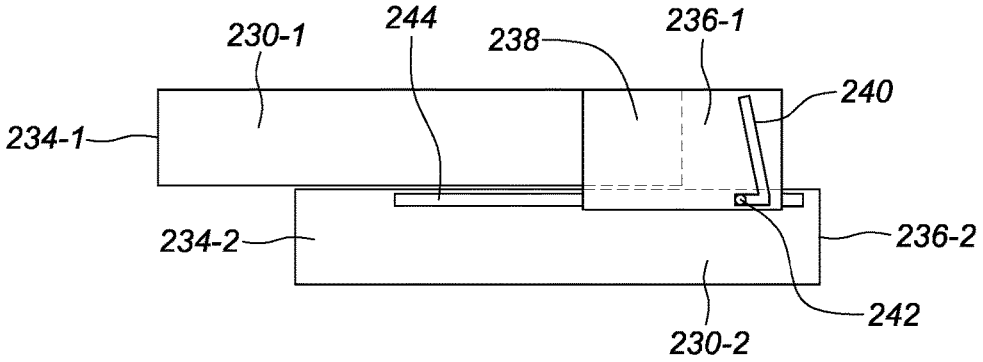

FIGS. 6A to 6C illustrate a first and second dock section in relation to a principle of operation of an alternate embodiment, in accordance with embodiments of the present disclosure. As depicted in FIG. 6A, a first dock section 230-1 can include a distal end 234-1 and a proximal end 236-1 is in a deployed state, along with a second dock section 230-2 that includes a distal end 234-2 and a proximal end 236-2. As further depicted, the proximal end 236-1 of the first dock section 230-1 abuts the distal end 234-2 of the second dock section 230-2. In some embodiments, the first dock section 230-1 can include a carrier plate 238 attached to its proximal end 236-1. In some embodiments, the carrier plate 238 can be attached to a lateral facing side of the first dock section 230-1. As depicted, the carrier plate 238 can define an L-groove 240, at a proximal end of the carrier plate 238. As depicted, a base of the L-groove 240 can be generally parallel with a longitudinally extending surface of the first dock section 230-1. In some embodiments, a carrier pin 242 can be attached to the second dock section 230-2 and can be disposed in a carrier channel 244, allowing for the carrier pin 242 to move proximally or distally along the second dock section 230-2, within the carrier channel 244.

As depicted in FIG. 6A, in a deployed position, the carrier pin 242 can be disposed at a most distal end of the carrier channel 244. As depicted, the L-groove 240 can be a canted L-groove, such that a top of the L-groove 240 is canted in a distal direction. As the first dock section 230-1 is lowered, such that a top surface of the first dock section 230-1 is even with a top surface of the second dock section 230-2, the carrier pin can be disposed in a top portion of the L-groove 240. Due to the proximally canted top portion of the L-groove 240, the proximal end 236-1 of the first dock section 230-1 can be drawn proximally towards the distal end 234-2 of the second dock section 230-2. As a result, the canted top portion of the L-groove 240 can introduce a force in the proximal direction, with respect to the first dock section 230-1, forcing the proximal end 236-1 of the first dock section 230-1 towards the distal end 234-2 of the second dock section.

As depicted in FIG. 6B, in a partially deployed state, the first dock section 230-1 has been lifted upward with respect to the second dock section 230-2 and the carrier pin has been positioned in a distal side of the bottom portion of the L-groove 240. In some embodiments, the bottom portion of the L-groove 240 can define a carrier pin cutout, such that the carrier pin 242 rests in the carrier pin cutout, thereby preventing the carrier pin 242 from coming out of the carrier pin cutout, unintentionally. As further depicted, when the carrier pin 242 is disposed in the bottom portion of the L-groove 240, a bottom surface of the first dock section 230-1 can be positioned above and/or can rest on a top surface of the second dock section 230-2, thereby allowing for the first dock section 230-1 to slide along the top of the second dock section 230-2, proximally or distally, to allow for the first dock section 230-1 to be stored on top of the second dock section 230-2.

As further depicted in FIG. 6C, the first dock section 230-1 has been moved further proximally with respect to the second dock section 230-2, such that the first dock section 230-1 can be stored on top of the second dock section 230-2. To deploy the first dock section 230-1, the first dock section 230-1 is pulled distally, until the carrier pin 242 contacts a distal end of the carrier channel 244 and knocks the carrier pin 242 proximally out of the bottom portion of the L-groove 240, allowing for the carrier pin to be knocked out of the bottom portion of the L-groove 240 and into the top portion of the L-groove 240, as shown in FIG. 6A.

Embodiments are described herein of various apparatuses, systems, and/or methods. Numerous specific details are set forth to provide a thorough understanding of the overall structure, function, manufacture, and use of the embodiments as described in the specification and depicted in the accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments, the scope of which is defined solely by the appended claims. While additional hand written disclosure is provided on the Figures themselves in terms of ranges and explanations associated with the various embodiments discussed herein, such additional hand written disclosure is intended to supplement the discussion of associated embodiments herein, but not limit the embodiments discussed herein. For example, various values associated with length and/or angles provided in the drawings serve as examples and embodiments of the present disclosure can range in these values. Furthermore, various features of the present disclosure discussed in relation to the drawings serve as examples to broaden and not limit the associated disclosure.

Reference throughout the specification to "various embodiments," "some embodiments," "one embodiment," or "an embodiment", or the like, means that a particular feature, structure, or characteristic described in connection with the embodiment(s) is included in at least one embodiment. Thus, appearances of the phrases "in various embodiments," "in some embodiments," "in one embodiment," or "in an embodiment," or the like, in places throughout the specification, are not necessarily all referring to the same embodiment. Furthermore, the particular features, structures, or characteristics may be combined in any suitable manner in one or more embodiments. Thus, the particular features, structures, or characteristics illustrated or described in connection with one embodiment may be combined, in whole or in part, with the features, structures, or characteristics of one or more other embodiments without limitation given that such combination is not illogical or non-functional.

It will be appreciated that the terms "proximal" and "distal" may be used throughout the specification with reference to a clinician manipulating one end of an instrument used to treat a patient. The term "proximal" refers to the portion of the instrument closest to the clinician and the term "distal" refers to the portion located furthest from the user. It will be further appreciated that for conciseness and clarity, spatial terms such as "vertical," "horizontal," "up," and "down" may be used herein with respect to the illustrated embodiments. However, embodiments of the present disclosure may be used in many orientations and positions, and these terms are not intended to be limiting and absolute.

Although at least one embodiment for a stowable dock system has been described above with a certain degree of particularity, those skilled in the art could make numerous alterations to the disclosed embodiments without departing from the spirit or scope of this disclosure. All directional references (e.g., upper, lower, upward, downward, left, right, leftward, rightward, top, bottom, above, below, vertical, horizontal, clockwise, and counterclockwise) are only used for identification purposes to aid the reader's understanding of the present disclosure, and do not create limitations, particularly as to the position, orientation, or use of the devices. Joinder references (e.g., affixed, attached, coupled, connected, and the like) are to be construed broadly and can include intermediate members between a connection of elements and relative movement between elements. As such, joinder references do not necessarily infer that two elements are directly connected and in fixed relationship to each other. It is intended that all matter contained in the above description or shown in the accompanying drawings shall be interpreted as illustrative only and not limiting. Changes in detail or structure can be made without departing from the spirit of the disclosure as defined in the appended claims.

Any patent, publication, or other disclosure material, in whole or in part, that is said to be incorporated by reference herein is incorporated herein only to the extent that the incorporated materials does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

What is claimed:

1. A dock system, comprising:

a first dock section, the first dock section including a first proximal end and a first distal end;

a second dock section, the second dock section including a second proximal end and a second distal end; and a moveable guide system that connects the first dock section and the second dock section in a deployed position, such that the first proximal end of the first dock section abuts the second distal end of the second dock section, wherein the moveable guide system is configured to allow for the first dock section to be guided into a stowed position, on top of the second dock section, wherein in a non-deployed position the second dock section is connected to the first dock section exclusively through a coupling arm, the coupling arm being:

pivotally connected to the first dock section at a first pivot point; and pivotally connected to a guide follower at a second pivot point, the guide follower being movable along a guide element.

2. The dock system of claim 1, further comprising a guide wheel disposed along the guide element.

3. The dock system of claim 2, wherein the moveable guide system is configured to allow for the proximal end of the first dock section to be moved above the distal end of the second dock section when transitioning the first dock section from the deployed position to the stowed position.

4. The dock system of claim 1, wherein the moveable guide system includes:

a guide plate disposed on a lateral side of the second dock section and configured to be moved proximally and distally along the second dock section; and the coupling arm connects the guide plate to the first proximal end of the first dock section.

5. The dock system of claim 4, wherein the coupling arm is configured to pivot about the first dock section and the guide plate.

6. The dock system of claim 5, wherein:

the proximal end of the first dock section is configured to be lifted over a distal end of the second dock section, and the first dock section is configured to be moved along a top of the second dock section, into the stowed position.

7. The dock system of claim 6, wherein the guide plate is configured to move proximally along the second dock section, as the first dock section is slid into the stowed position.

8. The dock system of claim 1, wherein the first dock section and the second dock section remain connected as the first dock section is guided into the stowed position.

9. The dock system of claim 1, wherein the moveable guide system includes a guide plate disposed on a lateral side of the second dock section and configured to be moved proximally and distally along the second dock section via at least one channel.

10. The dock system of claim 1, wherein the moveable guide system is configured to maintain a lateral alignment between the first dock section and the second dock section when the first dock section is guided into the stowed position.

11. The dock system of claim 1, wherein the guide system includes a coupling arm that links a first dock section with a wheel, wherein the wheel is disposed along a guide element located on the second dock section.

12. The dock system of claim 11, wherein the coupling arm is configured to pivot about the first dock section and the wheel.

13. The dock system of claim 1, wherein the guide system includes:

a guide plate attached to a lateral facing side of the first dock section, wherein the guide plate includes an L-groove, a carrier channel defined in a laterally facing side of the second dock section, and a carrier pin disposed in the carrier channel and in the L-groove.

14. The dock system of claim 13, wherein the carrier pin is disposed in a top of the L-groove when the first dock section and the second dock section are in the deployed position.

15. The dock system of claim 13, wherein the carrier pin is disposed in a base of the L-groove and at a proximal end of the carrier channel, when the first dock section and the second dock section are in the stowed position.

16. A dock system, comprising:

a first dock section, the first dock section including a first proximal end and a first distal end;

a second dock section, the second dock section including a second proximal end and a second distal end; and a moveable guide system, wherein:

the moveable guide system includes a first moveable guide system disposed on a first side of the dock system and a second moveable guide system disposed on a second side of the dock system, the moveable guide system connects the first dock section and the second dock section in a deployed position, such that the first proximal end of the first dock section abuts the second distal end of the second dock section, wherein the moveable guide system is configured to allow for the first dock section to be guided into a stowed position, on top of the second dock section, wherein in a non-deployed position the second dock section is connected to the first dock section exclusively through a coupling arm, the coupling arm being:

pivotally connected to the first dock section at a first pivot point; and pivotally connected at a second pivot point to a guide follower that is movable along a guide element.

17. The dock system of claim 16, wherein the moveable guide system is disposed on opposing lateral sides of the first dock section and the second dock section.

18. The dock system of claim 17, wherein the moveable guide system includes a pair of guide elements disposed along the opposing lateral sides of the second dock section.

19. The dock system of claim 18, wherein the moveable guide system includes a guide plate, configured to be moved longitudinally along the guide element.

20. The dock system of claim 19, wherein the guide plate is connected with the first proximal end of the first dock section via the coupling arm.

* * * * *